United States Patent [19]

Mattingly

[11] Patent Number: 4,667,362

[45] Date of Patent: May 26, 1987

[54] SCRAPER FOR CARPET SEAMING IRONS

[75] Inventor: Carl S. Mattingly, 234 Norman Ave., Clyde, Calif. 94520

[73] Assignees: Presentation Systems, Inc.; Carl S. Mattingly, both of San Francisco, Calif.

[21] Appl. No.: 752,945

[22] Filed: Jul. 8, 1985

[51] Int. Cl.[4] ..... A47L 25/00

[52] U.S. Cl. ..... 15/236 R; 15/104 S; 30/169

[58] Field of Search ..... 15/236 R, 104 S, 105, 15/111; 30/169, 172; 219/245; 38/69, 74, 88, 93, 94, 141

[56] References Cited

U.S. PATENT DOCUMENTS

| | | | |
|---|---|---|---|
| 1,377,484 | 5/1921 | Huneryager | 15/236 R X |
| 2,747,911 | 5/1956 | Kuever | 15/236 R X |
| 2,824,330 | 2/1958 | Williams | 15/104 S |
| 3,366,987 | 2/1968 | Giustino | 15/236 R X |
| 3,434,175 | 3/1969 | Bray | 15/236 R X |
| 3,530,524 | 9/1970 | Clemans | 30/172 X |

*Primary Examiner*—Edward L. Roberts
*Attorney, Agent, or Firm*—David E. Newhouse

[57] ABSTRACT

A scraper is described for removing carpet seaming glue and other debris baked and/or caked in the grooves of carpet seaming irons. The scraper has a serrated scraping edge configured to mate with and scrape a grooved bottom surface of a carpet seaming iron shoe.

6 Claims, 3 Drawing Figures

SCRAPER FOR CARPET SEAMING IRONS

BACKGROUND OF THE INVENTION

1. Field of the Invention

The invention relates to a scraper for removing materials adhering to the bottom grooved surface of a carpet seaming iron.

2. Description of the Prior Art

Carpet installers frequently are required to secure or seam two pieces of carpet together with a carpet seaming iron and carpet seaming tape.

Carpet seaming tape typically includes a fabric backing presenting a surface with carpet seaming glue The carpet seaming glue is normally solid at room temperature but melts when heated. The tape is positioned beneath the junction between the carpet pieces.

The carpet seaming iron positioned between the pieces of carpet melts the glue on the tape. Typically, such irons include a shoe, an electrical heating element and a handle extending upwardly from the shoe to allow the iron to be moved along the junction between the two pieces of carpet. The carpet seaming iron is moved along the junction between the two pieces of carpet for melting the glue on the surface of the carpet seaming tape. The respective edges of the carpet pieces being joined flow over the top of the shoe, around the handle of the iron and contact the melted glue on the surface of the tape behind the iron as it moves along the junction. The glue then cools and hardens securing the edges of the carpet together.

The integrity of the seam between the respective pieces of carpet depends on the quantity of glue at the junction. To locate the melted glue, the bottom surface of the carpet seaming iron shoe typically has a plurality of grooves which collect and distribute the melted glue in longitudinal beads aligned with the junction between the two pieces of carpet.

Carpet seaming irons are frequently left on either because of a problem or inattention, and glue and other debris gradually become caked and/or baked onto the bottom surface of the shoe filling and clogging the grooves causing the glue, as it is melted by the iron, to be pushed out around the edges of the shoe rather than collected and distributed in longitudinal beads aligned adjacent to the junction between the pieces of carpet. The resulting seam, under such circumstances is low quality.

Accordingly, carpet installers typically must remove any debris and glue baked onto the bottom of their the irons clogging the grooves before seaming two pieces of carpet together. Heads of nails, screw drivers, sticks, wire brushes or any thing else that is handy are typically used to remove the cake of glue and debris baked into the grooves on the bottom surface of the carpet iron shoe.

Carpet installers both need and deserve a tool specifically designed for removing the glue, debris and gunk that becomes baked onto the bottom surfaces of their trusty carpet seaming irons.

SUMMARY OF THE INVENTION

The invention is a scraper presenting a serrated scraping edge configured to mate with and scrape a grooved bottom surface of a carpet seaming iron shoe. The blade presenting the serrated edge is oriented angularly with respect to a handle for the scraper enabling the scraper to be drawn along the grooved bottom of the carpet seaming iron shoe when the shoe is hot.

A particular embodiment of the invented scraper contemplates a long central tooth shaped to be received in and to scrape the central deep longitudinal groove on the bottom of many typical carpet seaming iron shoes.

Other features, aspects, advantages and objects presented and accomplished by the invented scraper for removing the cake of glue and debris baked into the grooves of a typical carpet seaming iron shoe will become apparent and/or be more fully described and understood with reference to the following description and detailed drawing.

DESCRIPTION OF A PREFERRED EMBODIMENT

Figure 1:
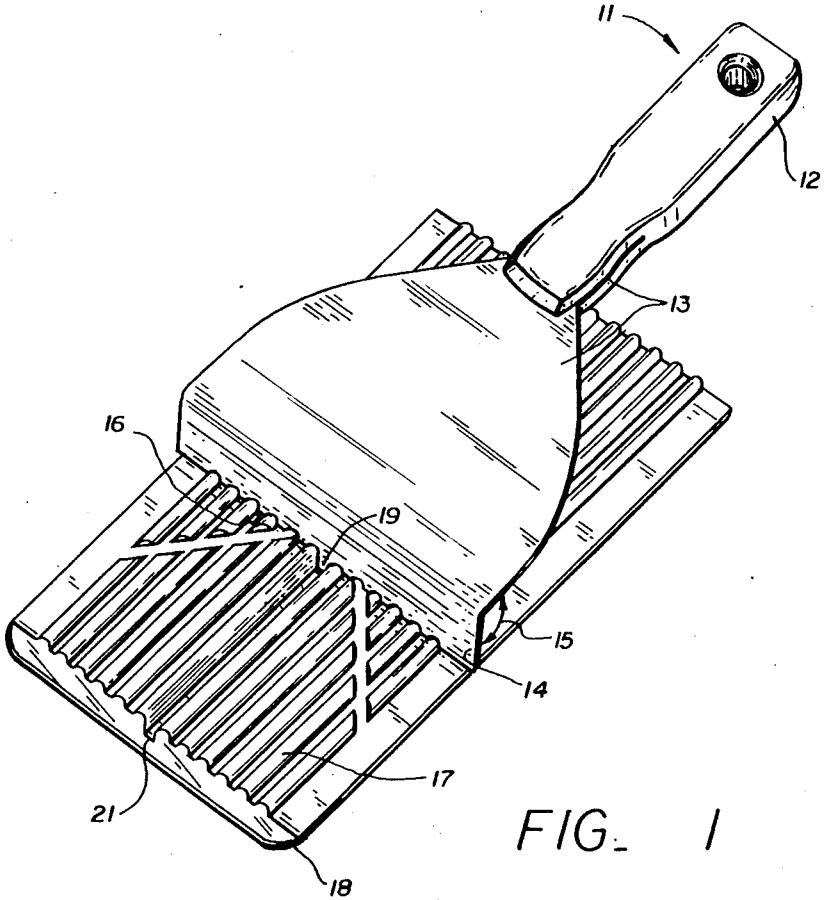
FIG. 1, is a perspective view of an embodiment of the scraper having a central elongated tooth adapted to be received within and to scrape a deep central groove cut into the bottom surface of a carpet iron shoe.
Figure 2:
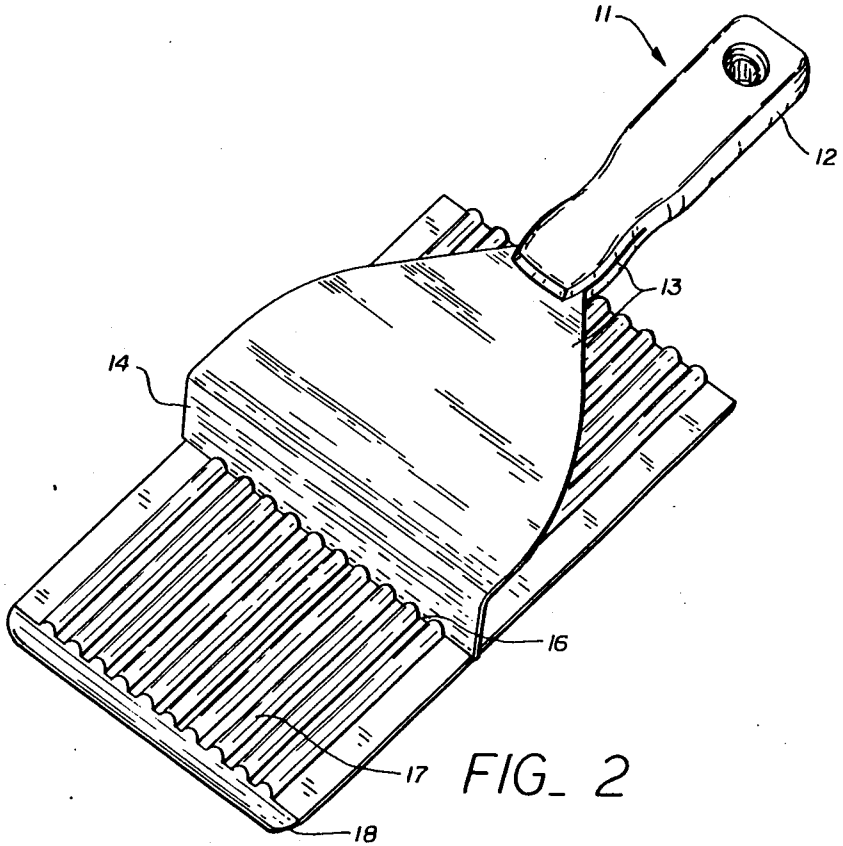
FIG. 2, is a perspective view of the invented scraper presenting a rippled scraping edge conforming to the ripples or corrugations on a bottom surface of another embodiment of a carpet seaming iron shoe.
Figure 3:
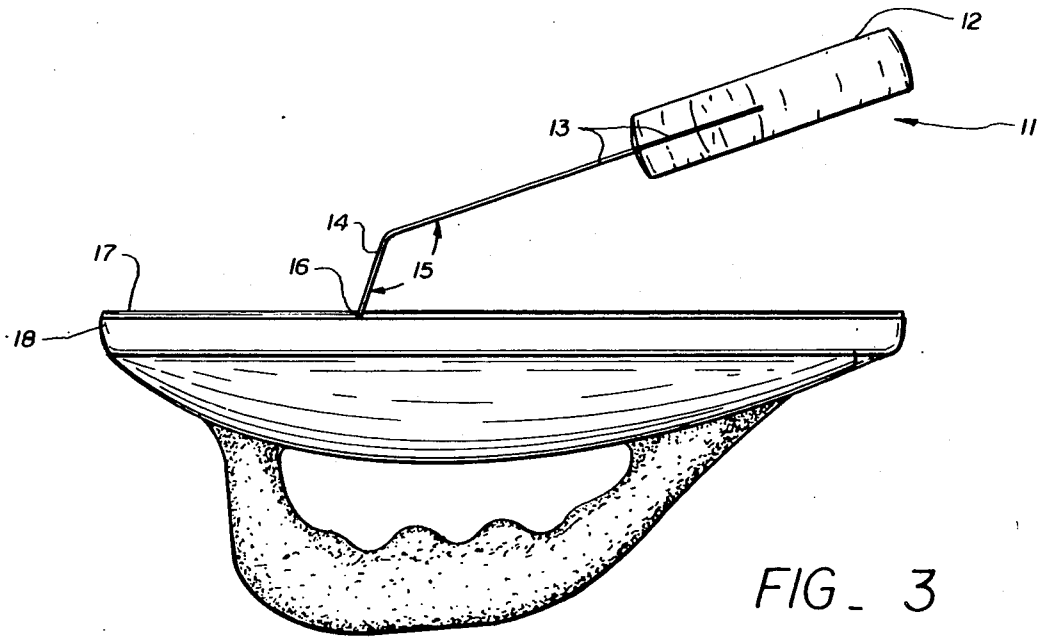
FIG. 3, is a cross sectional illustration showing the angular relationship between the scraping edge, and the handle of the scraper and the bottom surface of a carpet seaming iron.

As shown in FIGS. 1, 2 and 3, the invented scraper 11 includes a handle 12 riveted to a tang 13 which broadens integrally into a blade 14. The blade is bent at an obtuse angle 15 relative to the tang 13 and presents a serrated or toothed edge 16.

As illustrated, the scraper blade is planar. However, a curved blade 14 would also serve so long as the serrated or toothed edge can be presented in approximately a perpendicular relationship to the grooved or channeled bottom surface 17 of a carpet iron shoe 18.

The scraper shown in FIG. 1 includes a large central tooth 19 adapted to be received in a deep central groove 21 cut into the bottom surface 17 of the carpet seaming iron shoe 18. Many carpet seaming irons have such deep central grooves to locate a voluminous bead of melted glue at the junction between pieces of carpet being joined. Such carpet seaming irons also typically include grooves oriented angularly with respect to the central deep groove for directing the melted glue towards the central deep groove as the carpet seaming iron moves along the carpet seaming tape between the adjacent pieces of carpet. (FIG. 1)

Referring now to FIG. 3, the blade 14 of the scraper 11, is oriented at an obtuse angle with respect to the longitudinal axis of the scraper. In particular, the blade 14 presenting the toothed serrations 16 should be angled obtusely relative to the axis of the handle 12 of the scraper 11 so that the installer does not burn his hand as he pulls the scraper along the bottom surface 17 of the carpet seaming iron shoe 18. Such an angular relationship can be accomplished by smoothly bending a planar piece of metal around a radius to present a blade 14 with a serrated or toothed edge 16. The handle 12 should also be composed of a thermally insulative material such as wood.

The angle of the blade to the axis of the scraper also makes it easier for the installer to pull the scraper along the the grooved bottom surface 17 of the shoe 18. In ticular, the angular relationship between the plane of the blade 14 and the longitudinal axis of the scraper distributes the force applied through the handle of the scraper into two directions, perpendicular and parallel to the bottom surface of the shoe. Accordingly, the serrated or toothed edge 16, of the blade 14 will tend to gouge into the cake of glue and other debris deposited or baked in the grooves 23 on the bottom surface of the shoe 18 as the scraper is pulled or along the surface.

The invented scraper for cleaning glue, debris and other types of gunk caked and/or baked onto a grooved bottom surface of a carpet seaming iron has been described in context of a preferred and/or representative embodiment. Many modifications and variations can be made to the invented carpet seaming iron scraper which, while not described herein, fall within the spirit and scope of the invention as described in the appended claims.

I claim:

1. In combination with a carpet seaming iron having a bottom surface defined by a plurality of substantially identical, parallel grooves, a scraper for removing glue and debris baked in the plurality of parallel grooves of its bottom surface comprising in combination, a blade having a serrated edge, each serration having a configuration substantially similar to, and slightly smaller than the cross-sectional configuration of a groove, the serrations being spaced for insertion into the parallel grooves forming the bottom surface of the carpet seaming iron, whereby, each serration scrapes glue and debris from a particular groove as the blade, with its serrated edge oriented perpendicularly relative to the grooves, is drawn across the bottom surface of the iron in a direction parallel to the grooves, a tang integral with the blade extending perpendicularly with respect to the serrated edge, a handle composed of a thermally insulative material secured to the tang.

2. The scraper of claim 1 wherein the tang and handle are oriented at an angle relative to the blade.

3. The scraper of claim 2 wherein the blade and the tang are formed from a planar piece of metal which is bent to form a junction between the blade and tang, the tang narrowing from a width equaling that of the blade to a width equaling that of the handle, the handle having a shape configured to be held by a human hand.

4. The scraper of claim 1 wherein the blade curves around an axis perpendicular to the handle.

5. A scraper for removing glue and debris caked and/or baked onto a bottom heating surface of a carpet seaming iron having a plurality of parallel grooves comprising, a blade having a serrated edge with teeth configured and spaced for scraping baked glue and debris from the grooves in the bottom heating surface of the iron as the blade, with its serrated edge oriented perpendicularly with respect to the grooves, is drawn across the bottom surface of the iron in a direction parallel to that of the grooves, a handle secured to the blade oriented perpendicularly with respect to the serrated edge.

6. The scraper of claim 1, 2, or 5 wherein the bottom of the carpet seaming iron includes a deep central groove and the serrated edge of the blade includes a long central tooth dimensioned for scraping baked glue and debris from the deep central groove.

* * * * *